US009969531B2

(12) United States Patent
Zender

(10) Patent No.: US 9,969,531 B2
(45) Date of Patent: May 15, 2018

(54) DELIVERY BAG

(71) Applicant: Papier-Mettler KG, Morbach (DE)

(72) Inventor: Willibrord Zender, Waldweiler (DE)

(73) Assignee: Papier-Mettler KG, Morbach (DE)

( * ) Notice: Subject to any disclaimer, the term of this patent is extended or adjusted under 35 U.S.C. 154(b) by 0 days. days.

(21) Appl. No.: 14/928,888

(22) Filed: Oct. 30, 2015

(65) Prior Publication Data

US 2016/0122083 A1 May 5, 2016

(30) Foreign Application Priority Data

Oct. 31, 2014 (EP) ..... 14191359

(51) Int. Cl.

| | |
|---|---|
| ***B65D 33/00*** | (2006.01) |
| ***B65D 33/08*** | (2006.01) |
| ***B65D 33/10*** | (2006.01) |
| ***B65D 33/18*** | (2006.01) |
| *B31B 150/00* | (2017.01) |
| *B31B 155/00* | (2017.01) |
| *B31B 160/20* | (2017.01) |
| *B31B 70/86* | (2017.01) |

(52) U.S. Cl.

CPC ..... *B65D 33/08* (2013.01); *B65D 33/007* (2013.01); *B65D 33/10* (2013.01); *B65D 33/18* (2013.01); *B31B 70/864* (2017.08); *B31B 2150/00* (2017.08); *B31B 2155/00* (2017.08); *B31B 2160/20* (2017.08)

(58) Field of Classification Search

CPC ..... B65D 33/08; B65D 75/566; B65D 31/10; B65D 33/065; B65D 33/007; B65D 33/10; B65D 33/18; B29C 66/71; B31B 2150/00; B31B 5155/00; B31B 70/864; B31B 2160/20

USPC ..... 383/7, 10, 84, 86, 20

See application file for complete search history.

(56) References Cited

U.S. PATENT DOCUMENTS

| | | | | |
|---|---|---|---|---|
| 4,759,643 A * | 7/1988 | Canno | ..... | B65D 27/16 383/100 |
| 4,846,587 A * | 7/1989 | Hull | ..... | B65D 33/08 206/806 |
| 4,874,256 A * | 10/1989 | Baines | ..... | B65D 75/56 383/21 |

(Continued)

FOREIGN PATENT DOCUMENTS

| | | |
|---|---|---|
| DE | 10 2009 007 985 A1 | 2/2010 |
| DE | 20 2012 006901 U1 | 8/2012 |
| FR | 2 122 070 A5 | 8/1972 |

OTHER PUBLICATIONS

Search Report for application EP14191359.0 dated Apr. 22, 2015, 7 pages.

*Primary Examiner* — Peter Helvey

(74) *Attorney, Agent, or Firm* — Seed IP Law Group LLP

(57) ABSTRACT

The present disclosure relates to a delivery bag in which the lower end of the bag is closed and wherein said lower end of the bag comprises at least one carrier handle or one carrier loop, and wherein at the same time, the upper end of the bag has a closable first opening for introducing articles for delivery. The present disclosure additionally relates to the use of the delivery bag according to the present disclosure for the transportation of goods for delivery, in particular goods for delivery for mail order and online commerce, as well as a method for producing a delivery bag according to the present disclosure.

26 Claims, 4 Drawing Sheets

(56) References Cited

U.S. PATENT DOCUMENTS 4,913,693 A * 4/1990 Ball ..... B65D 75/563 493/194
4,931,033 A * 6/1990 Leeds ..... B31B 19/00 383/10
4,974,968 A * 12/1990 Mandus ..... B65D 33/001 206/806
5,026,173 A * 6/1991 Jensen ..... B65D 33/06 383/10
5,033,868 A * 7/1991 Peppiatt ..... B65D 33/10 383/10
5,048,976 A * 9/1991 Jung ..... B65D 75/566 383/10
5,121,995 A * 6/1992 Newman ..... B65D 33/06 383/207
5,158,368 A * 10/1992 Lichtwardt ..... B65D 33/10 383/10
5,160,308 A * 11/1992 Peppiatt ..... B65D 75/5866 493/213
5,322,450 A * 6/1994 Willing ..... B65D 75/566 383/10
5,338,118 A * 8/1994 DeMatteis ..... B65D 33/08 383/10
5,378,220 A * 1/1995 Bunn ..... B65F 1/0006 383/104
5,722,773 A * 3/1998 Conrad ..... B65D 33/065 383/10
8,790,009 B2 * 7/2014 Saville ..... B31B 1/00 383/10
9,520,150 B2 * 12/2016 Motsch ..... B65D 75/563
2005/0036716 A1 * 2/2005 Geyer ..... B65D 33/34 383/5
2005/0105832 A1 * 5/2005 Trinko ..... B65D 31/12 383/84
2010/0142859 A1 * 6/2010 Cushman ..... A47J 43/27 383/10
2011/0033133 A1 * 2/2011 Kujat ..... B65D 31/10 383/20
2013/0315507 A1 * 11/2013 Teixido Vidal ..... B65D 33/08 383/10

* cited by examiner

DELIVERY BAG

BACKGROUND

Technical Field

The present disclosure relates to a delivery bag and a method for producing delivery bags. The present disclosure further relates to the use of such a delivery bag for transporting goods for dispatch.

Description of the Related Art

Delivery bags are used in widely differing forms for delivery purposes. In contrast to standard shopping bags, such delivery bags frequently comprise a closable or even re-closable opening, wherein the intention in most cases is that goods for dispatch should not be seen, and furthermore, should be protected during transportation. Frequently, such delivery bags have no carrier handle and also no carrier loop. Plastic bags such as those usually provided in supermarkets however generally have a carrier handle or carrier loop. Despite this, delivery bags with a carrier handle are known e.g., from DE 10 2009 007 985.

Delivery bags are usually provided in large piece numbers. Here, the front wall of the bag and the rear wall of the bag are usually produced from a thin material in order to reduce costs and protect the environment. This is one reason why standard delivery bags usually have no carrier handles or carrier loops.

With a generic use of delivery bags, carrier handles or carrier loops usually subject the delivery bag to a tensile load, in particular the front wall of the bag and the rear wall of the bag. If the front wall of the bag and the rear wall of the bag are thin, said carrier handle or carrier loop can cause the bag to tear, so that the contents are lost, become dirty or damaged. Particularly in light of the fact that expensive brand clothing for women and/or men is frequently dispatched in such delivery bags, for example, this is wholly unacceptable for a mail-order company. Further it is disadvantageous that due to the tensile load, the closing mechanism of a delivery bag may open unintentionally. An additional disadvantage is that the carrier handles—if they are provided—are usually realized by stamping a punch-through hole into the goods holding area for articles to be delivered in the delivery bag. As a result of such a punch-through hole, the contents are however also exposed to the environmental conditions, a state which should be avoided in delivery bags.

A further disadvantage of standard delivery bags is that they are frequently not sufficiently protected against the weather, in order to be able to withstand heavy rain, for example.

BRIEF SUMMARY

Embodiments of the present disclosure thus include a delivery bag designed in such a manner that the disadvantages described above are overcome. In particular, embodiments of the present disclosure are designed to protect the contents of the delivery bag from humidity, for example in the form of rain. Further, the delivery bag should enable simple, accident-free, protected transportation of the contents, and provide good storability of the delivery bag. Finally, the contents of the delivery bag should be protected against unauthorized access and/or against unauthorized visual inspection by third parties.

In at least one embodiment of the present disclosure, a delivery bag comprises an upper end of the bag, an opposite lower end of the bag, a first edge of the bag and a second edge of the bag, together with a bag front wall and an opposite bag rear wall, wherein the bag front wall and the bag rear wall respectively comprise an upper edge, a lower edge, a first side edge and a second side edge. The lower end of the bag is closed and comprises at least one carrier handle or carrier loop, wherein the upper end of the bag comprises a closable, preferably re-closable, first opening for introducing articles for delivery.

Through the application of the at least one carrier handle or the at least one carrier loop to the lower end of the bag, which lies opposite the closable first opening, the delivery bag is generally carried using the carrier handle or carrier loop in such a manner that the closable first opening is aligned in the direction of the ground when the delivery bag is being carried. The upper end of the bag comprises the first opening for introducing articles for delivery. The upper end of the bag is thus the end which generally points upwards while the delivery bag is being filled, and which points downwards, i.e., in the direction of the ground, while the bag is being carried using the carrier handle or carrier loop.

Surprisingly, it has been shown that the fact that the closable first opening points downwards during carrying does not impair the secure storage or secure transportation of the articles to be delivered. Further, it has been shown that the avoidance of an opening on the end of the bag, on which the at least one carrier handle or the at least one carrier loop is located, extends the range of design options both with regard to the opening and also with regard to the carrier handle or carrier loop. In particular, the opening geometry no longer needs to be taken into account when designing the at least one carrier handle or the at least one carrier loop, and the tensile load capacity of the carrier handles or carrier loops is increased, since an opening may at times weaken the material cohesion of a delivery bag in the opening area. The dimensions of the opening are also no longer restricted by the carrier handles or carrier loops. Additionally, a closable opening is frequently not entirely watertight. This is not a problem with a bag according to the present disclosure. The opening is located on the end of the bag, which lies opposite the carrier handle or carrier loop. In contrast to the lower end of the bag, this end of the bag, which comprises the opening, is thus wettened less or not at all by rain, snow or hail.

BRIEF DESCRIPTION OF THE SEVERAL VIEWS OF THE DRAWINGS

Further features and advantages of the present disclosure are presented in the description below, in which preferred embodiments of the present disclosure are explained as examples with reference to schematic drawings, in which.

DETAILED DESCRIPTION

Figure 1A:
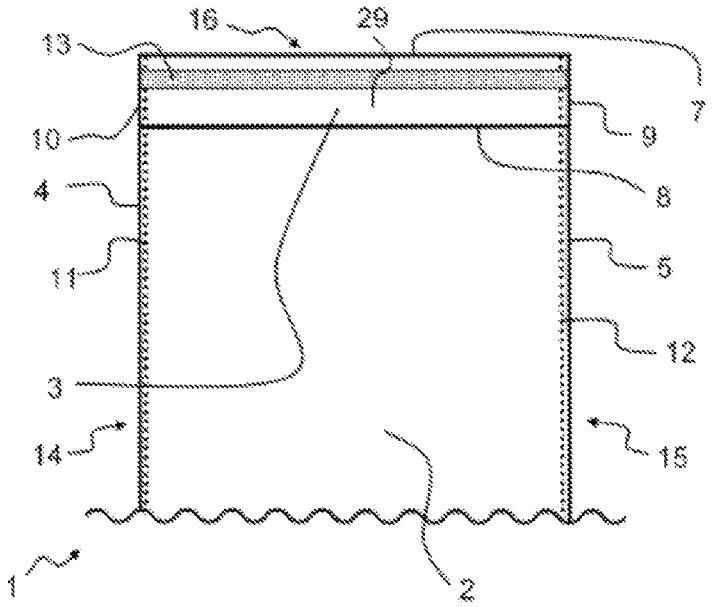
FIGS. 1A to 1C show schematic front views of different embodiments of the upper half of the delivery bag.

A delivery bag in the sense of the present disclosure is a bag which is provided for transporting goods, including but not limited to mail-order delivery goods. A delivery bag of this type is usually closable, preferably in such a manner that no opening remains unclosed. The delivery bag usually comprises at least one goods holding area, in particular an interior space for holding goods or articles for delivery, which can essentially be fully closed. Bags which comprise unclosable openings, which permit articles for delivery to fall out unintentionally during transportation, are as a rule unsuitable for use as delivery bags. It is fundamentally feasible to deform a delivery bag in such a manner that a precise description of the geometry is no longer possible. It should therefore be stated in advance with regard to the further embodiments disclosed herein that the description relates to an unfilled, non-deformed state of the delivery bag, wherein the delivery bag should preferably be regarded as being extended flat. This is usually the form in which the delivery bag is provided prior to being filled with articles for delivery.

Preferably, the lower end of the bag comprises a bag floor. In a particularly preferred manner, said bag floor is arranged at a distance of less than 3 cm, in some cases less than 2 cm, and in other cases less than 1 cm from the lower edge of the front wall of the bag. Here, the floor of the bag preferably restricts a goods holding area for articles for delivery in the direction of the lower end of the bag. This has the advantage that goods can if necessary have more space in the goods holding area for articles for delivery in the unfolded bag, or that more articles for delivery can be accommodated there.

The floor of the bag can in particular be formed by a bag floor wall and/or by at least one welded seam and/or at least one fold. The welded seam preferably runs at a distance from or along the lower edge of the rear wall of the bag and the front wall of the bag, in particular with an average distance of less than 3 cm, in some cases less than 2 cm, and in other cases less than 1 cm. The lower edges of the rear wall of the bag and the front wall of the bag are preferably fold edges of the at least one fold, in particular a W- or V-shaped fold.

Preferably, the floor of the bag is formed by a floor wall of the bag, in particular in the form of a folding floor. The floor wall of the bag considerably increases the size of the goods holding area for articles to be delivered, enabling more articles to be delivered to be accommodated there. A folding floor in the sense of the present disclosure usually comprises at least one fold edge, along which the floor can be folded together. The arrangement of the carrier handle or carrier loop can also be designed more advantageous when a bag floor wall is provided.

Preferably, the lower end of the bag comprises a fold with a W- or V-profile, wherein this is intended to describe the type of fold edge arrangement and not the angles between the fold edges. In the present document, the folds on the lower end of the bag are designated as being W- or V-shaped folds, or also as W- or V-folds. Preferably, these should always be understood as being the fold from which the floor wall of the bag is at least partially formed. Preferably, the different surfaces of the W- or V-fold lie in contact with each other in a folded state. With the V-shaped fold, a bag floor wall is usually not included. In this case, the V-shaped fold is formed from the front wall of the bag and the rear wall of the bag. Preferably, the W-shaped fold is formed by the front wall of the bag and the rear wall of the bag, as well as the floor wall of the bag. The floor wall of the bag can thus be integrated into the fold, and only requires a small amount of space, in particular when the delivery bags are stored.

Preferably, the front wall of the bag, the rear wall of the bag, the floor wall of the bag, the carrier handle and/or the carrier loop according to the present disclosure comprise at least one thermoplastic synthetic material. In a particularly preferred manner, the front wall of the bag, the rear wall of the bag, the floor wall of the bag, the carrier handle and/or the carrier loop consist of at least one thermoplastic synthetic material. Here, it can be provided that an imprint, such as an advertising imprint, is applied to the thermoplastic synthetic material. Thermoplastic synthetic materials stand out for their advantageous processability for the delivery bag according to the present disclosure. A welded seam in the sense of the present disclosure is preferably created by heating or melting (on) a narrow film area of a thermoplastic synthetic material, in particular to a temperature higher than the glass transition temperature. Through the application of pressure, a connection is thus obtained between the now welded parts following cooling down. Experience has shown that synthetic materials such as polyester and/or polyolefins, such as polyethylene, are particularly suited to this purpose. Preferably, the front wall of the bag, the rear wall of the bag and the floor wall of the bag comprise a first thermoplastic synthetic material, while the carrier handle or carrier loop comprise a second thermoplastic synthetic material with a different composition, or an entirely different material. The carrier handle or carrier loop also preferably comprise polyester and/or polyolefins, such as polyethylene.

Preferably, at least one wall of the bag, in particular the front wall of the bag and/or the rear wall of the bag and/or the floor wall of the bag is used which is made of synthetic material that is watertight and/or light-tight. Here, light-tight means that the light intensity is significantly reduced by the respective wall of the bag, preferably by at least 30%, in some cases by at least 50%, and in other cases, by at least 70%. The water tightness serves to protect the articles for delivery, in particular against weather-related influences such as rain, snow or air humidity. The reduction in the level of light intensity also serves as protection, particularly against UV bleaching, while also being important in order to ensure that postal confidentiality requirements are met if necessary.

In one preferred embodiment, the front wall of the bag, the rear wall of the bag and the floor wall of the bag are made of the same material, in particular from the same thermoplastic synthetic material. Here, it is particularly preferred when the front wall of the bag and the rear wall of the bag are based on one continuous section of a continuous material strip, preferably consisting of a single piece, in particular of a continuous synthetic material film, wherein preferably, the floor wall of the bag (if provided) is also based on the section of a material strip. Preferably, the front wall of the bag, the rear wall of the bag and in particular the floor wall of the bag are a component of a continuous material strip, in particular of a continuous synthetic material film. Preferably, the continuous material strip is welded onto the sides of the bag. The described structure has the advantage that production can be considerably simplified, and production costs can be reduced. In particular, no welded seams are required here in order to connect the front wall of the bag and the rear wall of the bag and, if appropriate, the floor wall of the bag, to the lower end of the bag. The different bag walls (the front wall of the bag, the rear wall of the bag and if appropriate, the floor wall of the bag) can be separated from each other by folds. In particular, the W-fold described above is suitable for separating the floor wall of the bag from the front wall of the bag and the rear wall of the bag. Here, the floor wall of the bag comprises a, preferably central, W-shaped fold which is part of the floor wall of the bag.

According to the present disclosure, the first edge of the bag is preferably formed by welding the first side edges of the front wall of the bag and the rear wall of the bag to a first welded seam and the second edge of the bag is formed by welding the second side edges of the front wall of the bag and the rear wall of the bag to a second welded seam. Here, the side edges are thus directly welded. This is advantageous; in this manner, the area for holding the goods for articles to be delivered can be maximized.

In an alternative embodiment, the welded seams do not coincide with the first and second side edges, but are at a distance from these edges. Here, it is preferred that the first edge of the bag comprises a first welded seam which runs at a first average distance from the first side edges of the front wall of the bag and the rear wall of the bag, and the second edge of the bag comprises a second welded seam which runs at a second average distance from the second side edges of the front wall of the bag and the rear wall of the bag. Preferably, the first average distance and the second average distance are equal. Further, it is preferred that the first average distance and/or the second average distance is less than 3 cm, in some cases less than 2 cm, and in other cases less than 1 cm. Welded seams which are not located directly on the side edges frequently have increased stability.

In further embodiments according to the present disclosure, the front wall of the bag and the rear wall of the bag are connected at the first or second edge of the bag at a distance from the corresponding side edges, in particular by means of welded seams, and that the corresponding side edges are directly connected to each other, in particular welded, on the opposite second or first edge of the bag. In this case, increased stability is achieved on one side, while on the opposite side, the area for holding goods is not restricted, or is only restricted to an insignificant degree.

It is preferred when the welded seams, in particular the first and second welded seam, which connect the front wall of the bag and the rear wall of the bag to the first and second edge of the bag, also weld two opposite edges of the floor wall of the bag and/or the at least one carrying strap or the at least one carrying handle in an advantageous design to the front wall of the bag and the rear wall of the bag. Preferably, these welded seams are thermoplastic welded seams. It has been shown that a particularly high degree of durability of the connecting points of the at least one carrier loop or the at least one carrier handle is achieved when they are formed by welding several layers, in particular three or five layers. With the floor wall of the bag, the protruding weld only insignificantly restricts the area which is available, or not at all. The use of said welded seam for connecting the front wall of the bag and the rear wall of the bag and for affixing the carrier handle or carrier loop and the floor of the bag reduces the number of working steps during production considerably, and thus results in reduced production costs of the delivery bags.

In a preferred embodiment, all welded seams have the same orientation. Preferably, the bag here comprises two welded seams, which weld the front wall of the bag, the rear wall of the bag and in particular also the floor of the bag to each other. Since this embodiment comprises only an orientation of the welded seams, the production process is particularly simple. Additionally, the stability of the bag is increased.

Carrier handles and carrier loops in the sense of the present disclosure are devices the purpose of which is to make holding and carrying the delivery bag easier. Here, the carrier handle preferably comprises at least one film layer with an insertion hole through which a user can push through their hand and/or their lower arm in order to lift the delivery bag. Such an embodiment should also be included within the scope of a carrier handle in the sense of the present disclosure in which a weakened zone is provided in a film layer which is designed for this purpose, for example in the form of a perforation line, in order to create such an insertion hole. Here, the perforation must be destroyed consistently, at least partially, before a hand and/or a lower arm can be pushed through. In a preferred embodiment, the insertion hole is created from the start. In a particularly preferred manner, the carrier handle is formed by a weakened zone in a film layer. Openings which are intended to enable access to the interior of the delivery bag, in particular openings for removing or inserting articles to be delivered, are however preferably not carrier handles in the sense of the present disclosure. In a preferred embodiment, the carrier handle is formed by a film layer which is inserted into the W-shaped fold and is in particular welded with said fold. The film layer is here not a part of the front wall of the bag, the rear wall of the bag and the floor wall of the bag, but is preferably connected, in particular, welded, to the front wall of the bag, the rear wall of the bag and/or the floor wall of the bag. The carrier handle preferably comprises a film layer which is welded on three sides, in particular with the front wall of the bag, the rear wall of the bag and the floor wall of the bag.

In contrast to the carrier handle, a carrier loop is preferably not formed as an insertion hole in a film layer of the bag, but instead comprises a carrier band in particular. Unlike the carrier handle, therefore, an opening is not created in an existing film wall, but usually, a carrier band, in particular a flexible carrier band, is used.

Preferably, the carrier band is formed by an in particular band-shaped, synthetic material film. However, it is also possible to produce a carrier band from paper. Instead of or in addition to a carrier band, a carrier loop can also comprise a carrier string or a carrier rope, for example. Carrier loops are regularly preferred over carrier handles. They generally permit larger openings for holding onto and furthermore, they usually consume less material. Carrier loops can also be designed to be more stable than carrier handles. It has surprisingly been shown that in particular also single-layer carrier loops—despite the fact that their connection area is usually smaller compared to carrier handles—can be securely and durably attached to the lower end of the bag.

In a preferred embodiment, the bag comprises at least one carrier handle or one carrier loop which is designed as a single layer. For the carrier handle, this means that the film layer is a single layer with the grip hole, and for the carrier loop that the carrier band, carrier string or carrier rope are in particular designed as a single layer. In a particularly preferred manner, said single layer is designed in such a manner that the carrier loop or carrier handle is at the same distance from the front wall of the bag and the rear wall of the bag. It is further preferred that the bag comprises precisely one carrier handle or one carrier loop which is designed as a single layer on the lower end of the bag.

Preferably, the at least one carrier handle or the at least one carrier loop is arranged at least partially, in particular fully, between the front wall of the bag and the rear wall of the bag. This does not mean that the carrier handle or carrier loop needs to be present in the interior of the bag. To a far greater degree, the floor, as described above, preferably comprises a W-shaped fold which is formed externally by the front wall of the bag and the rear wall of the bag. Thus a carrier handle or a carrier loop which is arranged within the W-shaped fold lies between the front wall of the bag and the rear wall of the bag. Other folds also permit such an arrangement. Preferably, the carrier handle or carrier loop is here surrounded by the floor wall of the bag which is in particular folded, for example when the carrier handle or the carrier loop is present in the center between the side folds of the W-shaped fold. This has the advantage that the carrier handle or the carrier loop only becomes visible when it is really needed. In particular, the stackability of the empty delivery bags is thus improved. Furthermore, the risk of accident is reduced, since unintentional snagging on the carrier handle or carrier loop is limited or completely avoided. Thus the advantages of standard delivery bags with and without a carrier handle or carrier loop are combined in the delivery bag according to the present disclosure, and the corresponding disadvantages are avoided.

In a preferred embodiment, the carrier handle or the carrier loop is formed from a different material and/or has a different material thickness, in particular an average film thickness, than the front wall of the bag and/or the rear wall of the bag. This enables it to meet the different demands on materials used in the bag walls and of the at least one carrier handle or the at least one carrier loop. For example, the material used for the front wall of the bag and/or the rear wall of the bag should be highly flexible and also inexpensive. Far less material is required for the carrier loop or the carrier handle, so that less consideration needs to be given to the cost. Flexibility is also less important. However, the carrier handle or carrier loop should preferably derive from a material which can withstand a higher tensile load than the material used for the front wall of the bag and the rear wall of the bag. Preferably, the material thickness, in particular the average thickness of a film, of the carrier handle or the carrier loop, should also be greater than that of the front wall of the bag and/or the rear wall of the bag.

In a preferred embodiment, the at least one carrier loop, in particular as a synthetic material or fabric band, is connected, in some cases welded, on the lower end of the bag via two connecting areas to the delivery bag, in some cases to the floor wall of the bag and/or the edge of the bag. Such a carrier handle or such a carrier loop also enables the user to carry the delivery bag over their arm or over their shoulder, thus enabling avoidance of fatigue when carrying by hand.

In a further preferred embodiment, the at least one carrier handle or the at least one carrier loop comprises a film band, in particular a film strip, in some cases with a width of 0.5 to 5 cm, and in other cases with a width of 1 to 3 cm, which extends substantially from the first to the second edge of the bag. Experience has shown that the forenamed widths are a good compromise between material consumption, manageability and secure carrying.

Experience has shown that it is preferred when only the lower end of the bag of the delivery bag comprises at least one carrier handle or at least one carrier loop. This has the advantage that a carrier handle or a carrier loop is situated only in the place where the closed end of the bag is sufficiently strengthened by the bag material. Embodiments are also particularly preferred with one or two carrier handles or carrier loops, in particular one carrier handle or one carrier loop. The distance from the first opening in the forenamed advantageous embodiment is thus sufficiently great in order to avoid impairing secure carrying or the stability of the carrier handle or the carrier loop.

Preferably, the front wall of the bag has a first length which corresponds to the average distance between the upper edge and the lower edge of the front wall of the bag, and the rear wall of the bag has a second length which corresponds to the average distance between the upper edge and the lower edge of the rear wall of the bag, wherein the first length is shorter than the second length, so that the rear wall of the bag protrudes over the front wall of the bag on the upper end of the bag. The portion of the rear wall of the bag which protrudes over the front wall of the bag can preferably be folded over in order to close the first opening on the upper end of the bag.

The front wall of the bag preferably also has a first width which corresponds to the average distance between the first and second side edge of the front wall of the bag, and the rear wall of the bag preferably has a second width which corresponds to the average distance between the first and second side edge of the rear wall of the bag. Preferably, the first and second widths are equal in size. In a particularly preferred manner, the width of the front wall of the bag is less than the length of the front wall of the bag, and the width of the rear wall of the bag is less than the length of the rear wall of the bag. This has the advantage that the carrier handle or carrier loop is arranged on the shorter portion of the delivery bag, which leads to greater stability.

Preferably, the rear wall of the bag comprises a fastening component on the upper end of the bag of the delivery bag, wherein said fastening component, particularly after a section of the rear wall of the bag has been folded over onto the front wall of the bag, is designed to close the first opening on the upper end of the bag. The section is preferably the section of the rear wall of the bag which protrudes on the upper end of the bag over the front wall of the bag. Alternatively or in addition, the front wall of the bag can also comprise a fastening component in order to close the first opening. By folding over, the bag is not deformed, or is only deformed to a slight degree, so that documents inside the bag are not creased, for example. In particular, an opening which uses a drawstring, for example, in order to narrow the opening through to full closure, would be less suitable for documents.

Preferably, the first opening can be closed with a fastening component comprising at least one first adhesive strip. This strip preferably extends along the upper end of the bag, in particular along (and if appropriate, at a distance from) the upper edge of the front wall of the bag and/or the rear wall of the bag. Adhesive strips enable rapid, secure sealing. In a preferred embodiment, the first opening can be closed using the fastening component, preferably with at least one first adhesive strip. Preferably, the rear wall of the bag on the inside and/or the front wall of the bag on the outside comprises said fastening component, in particular in such a manner that it comes into contact with the front wall of the bag or the rear wall of the bag if a section of the rear wall of the bag is folded onto the front wall of the bag.

The adhesive strips preferably have a width of between 0.3 cm and 3 cm, in some cases between 0.5 cm and 2 cm. Due to the suitable width, secure closure of the opening is ensured, wherein in particular, unintentional opening of the delivery bag is limited or completely avoided. In a further preferred embodiment, the adhesive strips irreversibly adhere opposite film layers. Here, irreversible means that the adhesion does not allow at least one, in particular adjacent, partial area of the film to be opened again without destruction. This is advantageous since in this manner, it is ensured that the opening, once closed, cannot be unintentionally opened during transportation, in particular during carrying using the carrier handle or on the carrier loop. In this manner also, unauthorized opening can also be determined.

In an advantageous embodiment, the first opening has a length which is less than the length of the upper edges of the front wall of the bag and/or the rear wall of the bag, which is in some cases greater than 70% of the length of the upper edges, and in other cases 90% of the length of said upper edges.

In a further preferred embodiment, the closable opening is equipped with two adhesive strips on the front wall of the bag and/or the rear wall of the bag which are at a distance from each other, preferably essentially parallel, wherein a destructible film area extends between said adhesive strips. Thus the adhesive strip which is closer to the upper end of the bag can be used in order to close the bag for the first time. The destructible film area can be destroyed in order to open the delivery bag. By destroying the film area, the first opening is released. The second adhesive strip, which is situated further away from the upper end of the bag, can be used in order to re-close the first opening. In an advantageous embodiment, said film area comprises at least one weakened line or weakened zone between adhesive strips which are at a distance from each other. In a particularly preferred embodiment, the first and second adhesive strips are essentially aligned parallel and at a distance from each other. Essentially parallel in the sense of the present disclosure means that the deviation from a parallel alignment is less than 10°, preferably less than 5°. Preferably, the average distance between the adhesive strips which are at a distance from each other is less than 9 cm, in some cases less than 7 cm, and in other cases, less than 5 cm.

In one embodiment, the delivery bag comprises only one first opening, so that the area for holding goods for articles for delivery is enclosed when the first opening is closed, and no humidity/contamination/dirt can enter through further openings. It should be noted that a weakened zone, in particular weakened lines in the form of perforation lines, still do not constitute an opening for inserting and removing goods in the sense of the present disclosure, but is simply an area in which, if appropriate, a second opening can be particularly easily created by destroying said weakened zone.

Since according to the present disclosure, the first opening usually points downwards during carrying using the carrier handle or the carrier loop, it is advantageous to use at least one irreversibly adhesive strip for closing the first opening. Thus, unintentional re-opening can be prevented. The irreversible adhesion of the first adhesive strip is in particular advantageous when at least one second opening can be formed without any problems, for example due to the weakened zone(s), in particular weakened line(s), which are designed and constructed for this purpose. In a preferred embodiment, the front wall of the bag, the rear wall of the bag and/or the floor wall of the bag comprises a weakened zone, wherein the destruction of the weakened zone releases the at least one second opening. This enables the formation of the second opening in order to remove an article for delivery. The weakened zone can be a weakened line which is curved or, preferably, linear. Preferably, the first and/or the second opening can be closed with at least one first adhesive strip. The weakened zone for forming a second opening is preferably not arranged in direct proximity to the first opening.

In a preferred embodiment, said weakened zone, in particular the weakened line, is arranged to form the second opening on the floor of the bag. This is advantageous since the second opening can then be formed on the end (lower end of the bag), which points upwards during carrying, so that particularly simple removal is possible. Further, it is advantageous that unintentional destruction of the weakened zone during carrying does not lead to the article falling out due to gravity, since the second opening would point upwards during carrying.

The present disclosure also relates to a method for producing a bag, in particular a delivery bag, as has been described above, comprising the following method steps, preferably in this sequence:

- Providing a first film or a first continuous film strip to form the front wall of the bag, the rear wall of the bag and the floor wall of the bag;
- Providing a second film or a second continuous film strip to form the carrier loop or carrier handle;
- Folding the first film or the first continuous film strip, so that a W-fold is present, wherein the second film or the second continuous film strip is enclosed by W-fold
- Forming two, preferably parallel welded seams at a distance from each other, so that the W-fold and the enclosed second film or the enclosed second continuous film strip is affixed.

Here, the first and second films described above are preferably film sections of a continuous film strip which have already been essentially cut to the dimensions of the front wall of the bag, the rear wall of the bag and the floor wall of the bag, or the dimensions of the carrier handle or carrier loop. A continuous film strip was, by contrast, not yet cut to said dimensions, but relates to a continuous production process band, which was subdivided into the delivery bag segments at a later point in time. The later point in time is preferably after or during the formation of the welded seams. Preferably, a continuous film strip is used. Preferably, the method is used for producing the delivery bag according to the present disclosure as described in the patent claims and in the description.

A delivery bag constructed according to the present disclosure provides excellent protection against environmental conditions, particularly rain and snow. The lower end points upwards during carrying, and thus, the upper end with the opening is not wettened, even during rain or snow. Further, the carrier handles and carrier loops are more stable, in particular, more stable with regard to tensile loads. The opening for inserting goods (the first opening) no longer impairs the stability of the carrier handles or carrier loops. The carrier handles or carrier loops are also attached in such a manner that the opening is not restricted. Further, the carrier handles or carrier loops can preferably be contained in the W-fold of the floor wall of the bag, so that they do not form an impediment during transportation (if they are not required in the interim).

Thus, due to the measures described above, it is possible to integrate carrier handles or carrier loops in delivery bags without disadvantageous effects such as those discussed in the background. In this case, carrier handles or carrier loops provide unequivocal added value for a mail-order company or parcel deliverer. They effectively prevent the delivery bag from slipping out of the carrier's hands, making it highly unlikely that the goods will be dropped. It is also generally more comfortable for the parcel deliverer to carry a parcel by a carrier handle or carrier loop. This is of particular importance when the parcel deliverer very frequently needs to carry delivery bags due to the nature of their job. Through the provision of carrier handles or carrier loops, work-related illnesses such as back pain can be prevented.

Figure 1B:
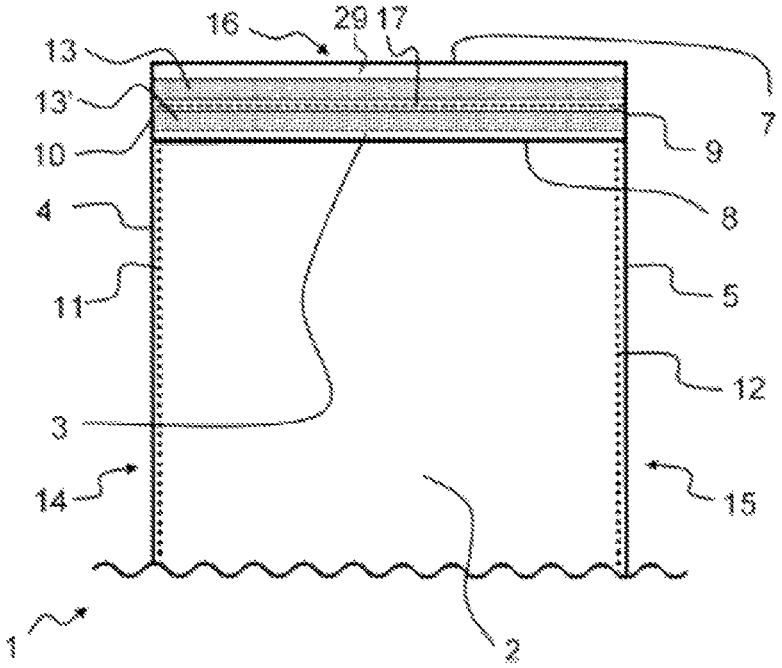
Figure 1C:
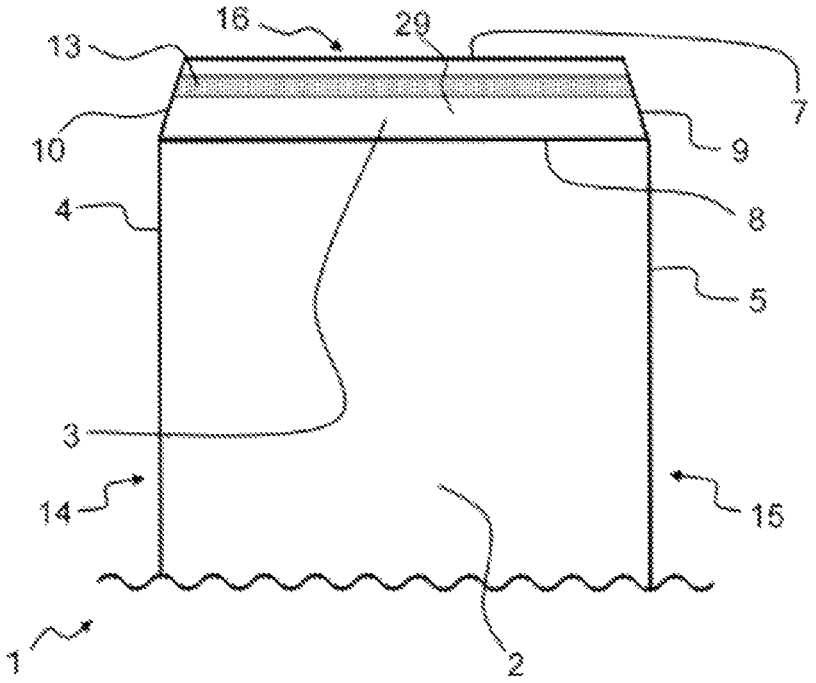

Turning now to the drawings, FIGS. 1A to 1C show different embodiments of the upper section 1 of a delivery bag, wherein in each case, the front wall of the bag 2 and an opposite, somewhat longer rear wall of the bag 3 on the upper end of the bag 16 is visible. In the depicted embodiment, the upper edge 8 of the front wall of the bag is lower than the upper edge 7 of the rear wall of the bag. The closable opening lies between the upper edges 7 and 8. The first side edge 4 of the front wall of the bag 2 lies on the first side edge 10 of the rear wall of the bag 3, wherein the latter is somewhat longer in the upper section. The visible section of the rear wall of the bag 3 is thus a section 29 which protrudes over the front wall of the bag 2. The second side edge 5 of the front wall of the bag 2 lies on the second side edge 9 of the rear wall of the bag 3, Wherein the latter is somewhat longer in the direction of the upper end of the bag 16. The delivery bag comprises a upper end of the bag 16, a first edge of the bag 14 and a second edge of the bag 15.

The embodiment in FIG. 1A shows a first edge of the bag 14 comprising a first welded seam 11 which connects the front wall of the bag 2 and the rear wall of the bag 3 at a distance from the first side edge 4. The second edge of the bag 15 comprises a second welded seam 12 which connects the front wall of the bag 2 and the rear wall of the bag 3 at a distance from the second side edge 5. The distance between the side edges 4 and 5 and the related welded seams 11 and 12 is essentially constant. In at least one embodiment, though not required, the welded seams 11 and 12 extend over the entire length of the bag, wherein the welded seam also lies above the upper edge 8 of the front wall of the bag. This is advantageous since during manufacture, continuous welded seams are easier to create. The closable opening can be sealed with an adhesive strip 13, whereby the section 29 of the rear wall of the bag 3 which protrudes over the front wall of the bag 2 is folded over onto the front wall of the bag 2. Usually, a cover strip on the adhesive strip is first removed, which prevents the adhesive strip 13 from already adhering at an early point in time and in an uncontrolled manner to other objects such as articles for delivery. This is particularly important when the delivery bag is sold in the form of delivery bag stacks. An adhesive strip of this nature in the form of a film which prevents unintentional adhesion of adhesive strips is generally common among generic adhesive strips.

FIG. 1B shows a further embodiment of the upper section 1 of the delivery bag. Like the embodiment in FIG. 1A, a bag is shown with a first edge of the bag 14 comprising a first welded seam 11 which connects the front wall of the bag 2 and the rear wall of the bag 3 at a distance from the first side edge 4. The second edge of the bag 15 comprises a second welded seam 12 which connects the front wall of the bag 2 and the rear wall of the bag 3 at a distance from the second side edge 5. The distance between the side edges 4 and 5 and the related welded seams 11 and 12 is essentially constant. In this embodiment, the welded seams 11 and 12 do not extend over the entire length of the delivery bag, but only up to the upper edge 8 of the front wall of the bag 2. Since here, the front wall of the bag 2 comes to an end, the welded seams are not necessarily required above the upper edge 8. Further, the embodiment in FIG. 1B, in contrast to the embodiment in FIG. 1A, comprises a further parallel adhesive strip 13' in addition to the adhesive strip 13. Between the adhesive strips 13 and 13', a destructible line 17 is provided, such as a weakened line in the form of a perforation line. The line 17 can alternatively also be separated using scissors.

The destruction of the line 17 also destroys the area between the adhesive strips 13 and 13' in the sense of the present disclosure. The bag can be closed with the adhesive strip 13 by removing the cover strip of the adhesive strip 13 and folding over the section 29 of the rear wall of the bag 3 which protrudes over the front wall of the bag 2 onto the front wall of the bag 2, so that the adhesive strip 13 comes into adhesive contact with the front wall of the bag 2. It is now possible, however, to open the delivery bag, even though the adhesive strip 13 adheres irreversibly, by destroying the area along the line 17. Thus, the first opening is again released along the line 17. The first opening can be re-closed by folding over the section of the rear wall of the bag 3 forwards onto the front wall of the bag 2 below the line 17, and re-closing it using the adhesive strip 13'. Thus the embodiment, despite the irreversible adhesion with the adhesive strips 13 and 13', provides an opportunity of opening the bag one single time and re-sealing it. It is clear to persons skilled in the art that more adhesive strips are possible, enabling multiple opening and closure. Such embodiments, with adhesive strips which are interrupted by destructible film areas, are particularly preferred.

FIG. 1C shows a further embodiment of the upper section 1 of the delivery bag. Welded seams cannot be seen. This is due to the fact that the welded seams are not at a distance from the side edges 4 and 5, but that the side edges 40 and 10 or 5 and 9 have themselves been welded together (at least in the section below the upper edge 8 of the front wall of the bag 2). Further, the rear wall of the bag 3 is tapered in section 29 above the upper edge 8 of the front wall of the bag 2, so that side edges 9 and 10 are not linear over the entire length of the bag. Thus the side edges 9 and 10 of the rear wall of the bag 3 in the section above the upper edge 8 cannot stand out when a section of the rear wall of the bag is folded over onto the front wall of the bag.

Figure 2A:
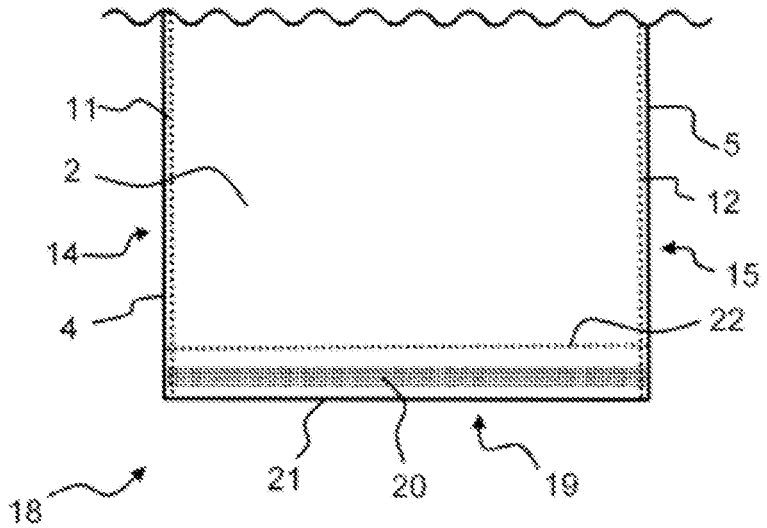
FIGS. 2A and 2B show schematic front views of different embodiments of the lower half of the delivery bag.

FIG. 2A shows an embodiment of the lower section 18 of the delivery bag. The embodiment in FIG. 2A can, for example, be combined with the upper sections 1 of the embodiment according to FIG. 1A or 1B. The delivery bag comprises a lower end of the bag 19, a first edge of the bag 14 and a second edge of the bag 15. The first edge of the bag 14 comprises a first welded seam 11 which connects the front wall of the bag 2 and the rear wall of the bag (not shown, since it is entirely covered by the front wall of the bag 2) at a distance from the first side edge 4. The front wall of the bag 2 is restricted by the lower edge 21 in the direction of the lower end of the bag 19. The second edge of the bag 15 comprises a second welded seam 12 which connects the front wall of the bag 2 and the rear wall of the bag 3 at a distance from the second side edge 5. The floor wall of the bag is folded in a V-shape and is in contact on the lower end of the bag 19 between the front wall of the bag 2 and the rear wall of the bag. Together with the front wall of the bag 2 and the rear wall of the bag, the floor wall of the bag forms a W-shaped fold. For clarification purposes, the fold edge of the V-shaped fold of the floor wall of the bag (or the middle fold edge of the W-shaped fold) is illustrated by the broken line 22. The fold edge 22 is however usually not visible, since it is covered by the front wall of the bag 2 (or when the delivery bag is rotated by 180°, by the rear wall of the bag). The floor wall of the bag extends from the first edge of the bag 14 to the second edge of the bag 15, and is there welded to the front wall of the bag 2 and the rear wall of the bag through welded seams 4 and 5. In the V-shaped fold (or in the W-shaped fold), a carrier loop is inserted in the form of a synthetic material strip 20. The carrier loop 20 also extends from the first edge of the bag 14 to the second edge of the bag 15, and is there welded at the respective connecting points to the front wall of the bag 2 and the rear wall of the bag through welded seams 4 and 5.

Figure 2B:
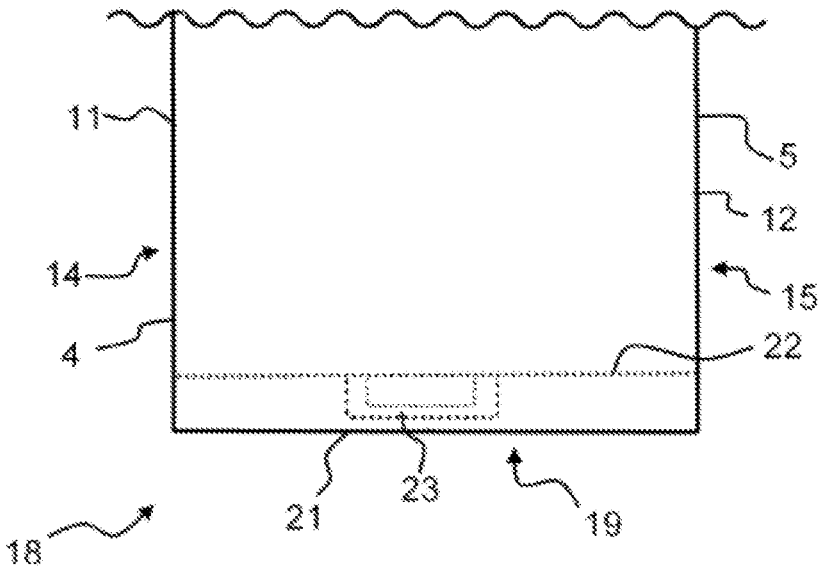

FIG. 2B shows a further embodiment of the lower section 18 of the delivery bag. In a similar manner to FIG. 1C, welded seams are not labelled, but the side edges 4 and 10 or 5 and 9 are directly welded. The floor wall of the bag extends from the first edge of the bag 14 to the second edge of the bag 15 and is there welded with side edges 4 and 10 or 5 and 9. In this embodiment, the carrier loop is a fabric loop 23 which is affixed to the floor wall of the bag. It is inserted into the fold of the floor wall of the bag in such a manner that it is covered in a folded state by the front wall of the bag 2.

Figure 3:
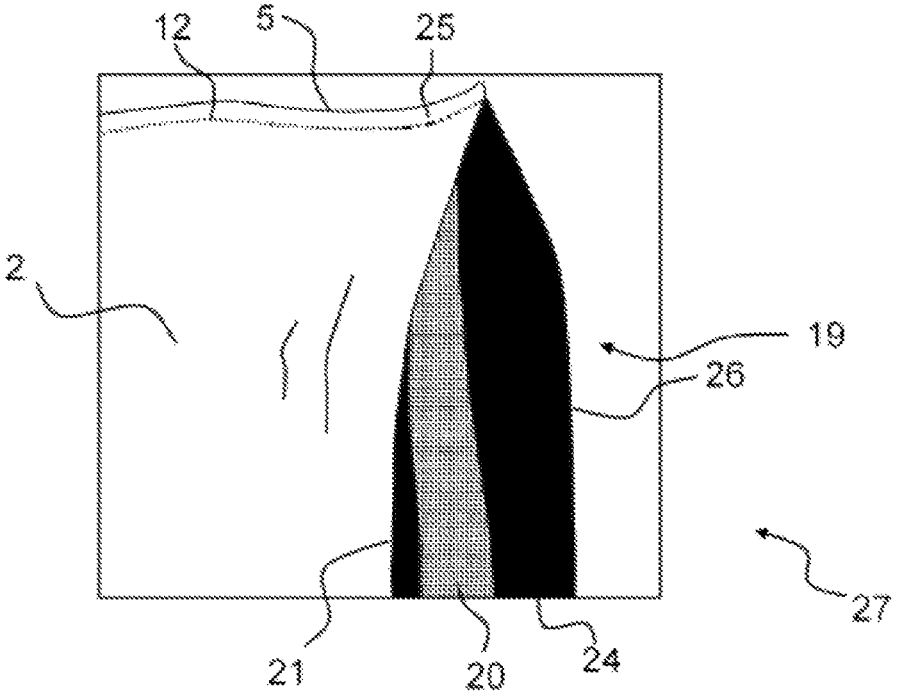
FIG. 3 shows a perspective view of a corner of the delivery bag on the lower end of the bag according to FIG. 2A, wherein the lower edges of the front wall of the bag and the rear wall of the bag are pulled apart to make the carrier loop visible.

FIG. 3 shows a perspective view of a corner 27 of the delivery bag on the lower end of the bag 19 according to the embodiment shown in FIG. 2A, wherein the lower edges 21 and 26 of the front wall of the bag 3 and the rear wall of the bag are pulled apart. The state of the bag shown here is thus a deformed state in order to grant a view onto the carrier loop in the form of a synthetic material band or synthetic material strip 20. The floor wall of the bag 24 is visible behind said synthetic material strip 20 as a black area. The second welded seam 12 is also shown, at a distance from the second side edge 5 of the front wall of the bag 2. The carrier loop is welded at the connecting point 25 to the welded seam 12.

Figure 4:
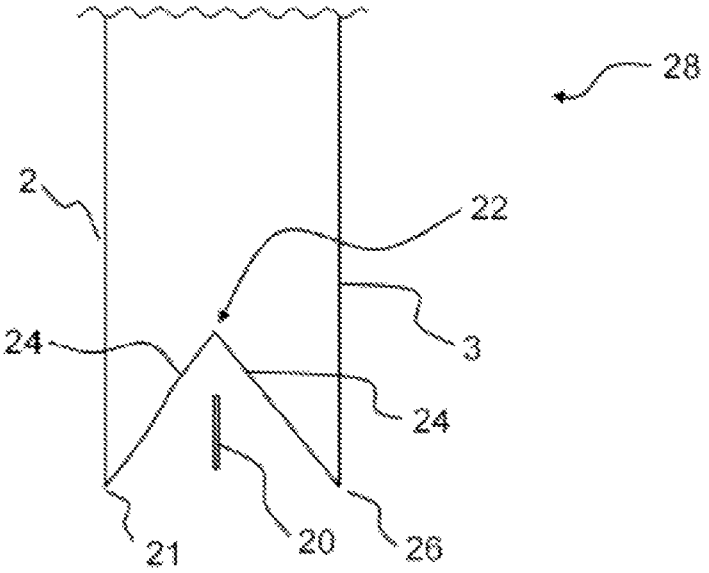
FIG. 4 shows a schematic profile view of the delivery bag on the lower end of the bag according to FIG. 2A, wherein the profile along the delivery bag runs through the center.

FIG. 4 shows a schematic profile or side view 28 of the delivery bag on the lower end of the bag according to the embodiment in FIG. 2A, wherein the profile along the delivery bag runs through the center. Thus the side edges and edges of the bag are not visible. From the profile view, the type of W-fold can be seen, wherein the two outer legs are formed by the front wall of the bag 2 and the rear wall of the bag 3, while the floor wall of the bag 24 forms the central part and is itself folded in a V-shape on the fold edge 22. The fold edges between the front wall of the bag 2 and the rear wall of the bag 3 and the floor wall of the bag 24 are also at the same time the lower edges 21 and 26 of the front wall of the bag 2 and the rear wall of the bag 3. The carrier loop in the form of a synthetic material strip 20 is inserted into the W-fold.

The features of the present disclosure disclosed in the above description, in the claims and in the drawings can be essential both individually and in any combination required for the realization of the present disclosure in its different embodiments.

The various embodiments described above can be combined to provide further embodiments. All of the publications referred to in this specification are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A delivery bag, comprising:

an upper end of the bag, an opposite lower end of the bag, a first edge of the bag, and a second edge of the bag, together with a bag front wall and an opposite bag rear wall, wherein the bag front wall and the bag rear wall respectively comprise an upper edge, a lower edge, a first side edge, and a second side edge, wherein:

the lower end of the bag is closed and comprises at least one carrier loop, and further comprises a bag floor, the upper end of the bag comprises a closable or re-closable first opening for introducing articles into the bag for delivery, the lower end of the bag comprises a W-shaped fold in profile, wherein the W-shaped fold is formed by the front wall of the bag, the rear wall of the bag, and a floor wall of the bag, the first edge of the bag is formed by the first side edges of the front wall of the bag and the rear wall of the bag welded together by a first welded seam, and the second edge of the bag is formed by the second side edges of the front wall of the bag and the rear wall of the bag welded together by a second welded seam, the W-shaped fold is welded at peripheral welded seams of the bag, wherein the peripheral welded seams are the first and second welded seams in which the first edge of the bag is formed and the second edge of the bag is formed, the at least one carrier loop is enclosed by the floor wall of the bag in such a manner that the at least one carrier loop is accommodated between the side folds of the W-shaped fold, and the first and second welded seams, which connect the front wall of the bag and the rear wall of the bag to the first and second edges of the bag, also weld two opposite edges of the floor wall of the bag and the at least one carrying loop to the front wall of the bag and the rear wall of the bag.

2. The delivery bag according to claim 1, wherein:

the bag floor restricts a goods holding area in the bag for articles for delivery in the direction of the lower end of the bag.

3. The delivery bag according to claim 1, wherein:

the front wall of the bag and the rear wall of the bag are based on a continuous section of a continuous material strip.

4. The delivery bag according to claim 3, wherein:

a floor wall of the bag is also a component of said continuous section of a continuous material strip.

5. The delivery bag according to claim 3, wherein:

the front wall of the bag, the rear wall of the bag, and the floor wall of the bag are components of a section of a continuous material strip, wherein the front wall of the bag and the rear wall of the bag are separated from the floor wall of the bag by folds.

6. The delivery bag according to claim 1, wherein:

the first edge of the bag comprises a first welded seam which runs at a first average distance from the first side edges of the front wall of the bag and the rear wall of the bag, and the second edge of the bag comprises a second welded seam which runs at a second average distance from the second side edges of the front wall of the bag and the rear wall of the bag.

7. The delivery bag according to claim 6, wherein:

the first average distance and the second average distance are essentially the same and are less than 2 cm.

8. The delivery bag according to claim 1, wherein:

the front wall of the bag and the rear wall of the bag are connected at the first or second edge of the bag at a distance from the corresponding side edges of the front and rear walls of the bag.

9. The delivery bag according to claim 1, wherein:

the front wall of the bag and the rear wall of the bag are connected at the first or second edge of the bag at a distance from the corresponding side edges by welded seams, and the corresponding side edges are directly welded to each other on the opposite second or first edge of the bag.

10. The delivery bag according to claim 1, wherein:

the at least one carrier loop is affixed using connecting points to a floor of the bag and/or of the front wall of the bag and the rear wall of the bag.

11. The delivery bag according to claim 10, wherein:

the at least one carrier loop is affixed using connecting points with welded seams.

12. The delivery bag according to claim 11, wherein:

the welded seams are first and second welded seams in which the first edge of the bag is formed and the second edge of the bag is formed.

13. The delivery bag according to claim 1, wherein:

the front wall of the bag, the rear wall of the bag, a floor wall of the bag, and/or the carrier loop or at least one film layer of the carrier loop comprise at least one thermoplastic synthetic material, and/or the front wall of the bag and/or the rear wall of the bag and/or the floor wall of the bag are water- and light-tight.

14. The delivery bag according to claim 1, wherein:

the at least one carrier loop, consists of a different material and/or comprises a different material thickness than the front wall of the bag and/or the rear wall of the bag.

15. The delivery bag according to claim 14, wherein:

the at least one carrier loop, consists of a material that withstands a higher tensile load than the material used for the front wall of the bag and/or the rear wall of the bag.

16. The delivery bag according to claim 1, wherein:

the at least one carrier loop is a film strip with a width of 0.5 to 5 cm, which extends from the first edge to the second edge of the bag.

17. The delivery bag according to claim 16, wherein the at least one carrier loop is a film strip with a width of 1 to 3 cm.

18. The delivery bag according to claim 1, wherein:

the front wall of the bag has a first length which corresponds to an average distance between the upper edge and the lower edge of the front wall of the bag, and the rear wall of the bag has a second length which corresponds to an average distance between the upper edge and the lower edge of the rear wall of the bag, wherein the first length is shorter than the second length so that the rear wall of the bag protrudes over the front wall of the bag on the upper end of the bag, and the section of the rear wall of the bag which protrudes over the front wall of the bag can be folded onto the front wall of the bag.

19. The delivery bag according to claim 18, wherein:

the front wall of the bag or the rear wall of the bag comprises at least one fastening component on the upper end of the bag, wherein said at least one fastening component is designed to close the first opening on the upper end of the bag.

20. The delivery bag according to claim 19, wherein:

the at least one fastening component is at least one first adhesive strip which extends substantially from one side edge of the bag to the other side edge of the bag.

21. The delivery bag according to claim 20, wherein:

the first opening is re-closable by a second adhesive strip, and the rear wall of the bag comprises a weakened zone which is arranged between the first adhesive strip and the second adhesive strip positioned at a distance from the first adhesive strip.

22. The delivery bag according to claim 1, wherein:

the bag floor is formed by the floor wall of the bag and/or by at least one welded or adhesive seam and/or at least one fold.

23. The delivery bag according to claim 22, wherein:

the at least one welded or adhesive seam runs at a distance from or along the lower edge of the rear wall of the bag and the front wall of the bag.

24. The delivery bag according to claim 22, wherein:

the at least one welded or adhesive seam runs with an average distance of less than 2 cm from or along the lower edge of the rear wall of the bag and the front wall of the bag.

25. The delivery bag according to claim 22, wherein:

the lower edges of the rear wall of the bag and the front wall of the bag are fold edges of the at least one fold.

26. A delivery bag, comprising:

an upper end of the bag, an opposite lower end of the bag, a first edge of the bag, and a second edge of the bag, together with a bag front wall and an opposite bag rear wall, wherein the bag front wall and the bag rear wall respectively comprise an upper edge, a lower edge, a first side edge, and a second side edge, wherein:

the lower end of the bag is closed and comprises at least one carrier loop, and further comprises a bag floor, the upper end of the bag comprises a closable or re-closable first opening for introducing articles into the bag for delivery, the lower end of the bag comprises a W-shaped fold in profile, wherein the W-shaped fold is formed by the front wall of the bag, the rear wall of the bag, and a floor wall of the bag, the first edge of the bag is formed by the first side edges of the front wall of the bag and the rear wall of the bag welded together by a first welded seam, and the second edge of the bag is formed by the second side edges of the front wall of the bag and the rear wall of the bag welded together by a second welded seam, the W-shaped fold is welded at peripheral welded seams of the bag, wherein the peripheral welded seams are the first and second welded seams in which the first edge of the bag is formed and the second edge of the bag is formed, the at least one carrier loop is enclosed by the floor wall of the bag in such a manner that the at least one carrier loop is accommodated between the side folds of the W-shaped fold, and the first and second welded seams, which connect the front wall of the bag and the rear wall of the bag to the first and second edges of the bag, also weld two opposite edges of the floor wall of the bag and the at least one carrying loop to the front wall of the bag and the rear wall of the bag, and wherein the first opening is closable or re-closable by at least one adhesive strip.

* * * * *